US005997696A

United States Patent [19]

Gustavsson et al.

[11] Patent Number: 5,997,696

[45] Date of Patent: Dec. 7, 1999

[54] SHOE PRESS

[75] Inventors: Lars Gustavsson, Karlstad; Erik Brox, Forshaga, both of Sweden

[73] Assignee: Valmet-Karlstad AB, Sweden

[21] Appl. No.: 09/164,156

[22] Filed: Sep. 30, 1998

Related U.S. Application Data

[60] Provisional application No. 60/069,897, Dec. 17, 1997.

[30] Foreign Application Priority Data

Sep. 30, 1997 [SE] Sweden ..... 9703571
Nov. 19, 1997 [SE] Sweden ..... 9704235

[51] Int. Cl.[6] ..... D21F 3/00; D21H 11/00; B29C 43/46

[52] U.S. Cl. ..... 162/358.3; 162/358.4; 162/358.5; 162/361; 492/7

[58] Field of Search ..... 162/358.3, 358.4, 162/358.5, 361; 492/7

[56] References Cited

U.S. PATENT DOCUMENTS 4,713,147 12/1987 Saarinen ..... 162/358.3

FOREIGN PATENT DOCUMENTS 0 345 501 12/1989 European Pat. Off. .
195 15 832 C1 5/1996 Germany .

*Primary Examiner*—Peter Chin
*Assistant Examiner*—Dionne A. Walls
*Attorney, Agent, or Firm*—Alston & Bird LLP

[57] ABSTRACT

A shoe press for a paper or board machine, comprising a press shoe and a counter roll which between themselves form an extended nip for a paper or cardboard web and a circulated flexible belt, and at least one loading cylinder which is arranged between a supporting beam included in the frame system of the shoe press and the press shoe and adapted to press the press shoe against the counter roll. The press shoe is arranged on top of the loading cylinder and there is a device for releasably securing the loading cylinder on the supporting beam. With the aid of eccentric means arranged on upstream and downstream sides of the loading cylinder or cylinders, each loading cylinder is positionable in multiple locations in the machine direction for regulating the pressure profile of the shoe press.

17 Claims, 2 Drawing Sheets

SHOE PRESS

CROSS-REFERENCE TO RELATED APPLICATION

This application claims priority to U.S. Provisional Patent Application Serial No. 60/069,897 filed Dec. 17, 1997.

FIELD OF THE INVENTION

The present invention relates to a shoe press for a paper or board machine, of the type having a press shoe for pressing a running fibrous web against a counter roll and a loading cylinder for urging the press shoe toward the counter roll. More particularly, the invention relates to such a shoe press in which the loading cylinder is adjustable in position in the machine direction along which the web travels.

BACKGROUND OF THE INVENTION

Various types of shoe presses and the like are commonly used for performing pressing operations on a running fibrous web in a paper or board machine. For instance, in the press section of a paper or board machine, the running web is dewatered by pressing the web in one or more shoe presses. Each of the shoe presses comprises a press shoe and a counter roll which between themselves form an extended nip through which the running web is carried by a circulated flexible belt. At least one loading cylinder is arranged between a supporting beam of the shoe press and the press shoe and adapted to press the press shoe against the counter roll.

There is frequently a desire to be able to vary the character of the pressure profile exerted on the running web in the nip of a shoe press, particularly in the machine direction along which the web travels. Accordingly, various mechanisms have been developed for shifting the position of a center of load exerted on a press shoe.

For example, a shoe press with a device for moving a press shoe relative to the shoe press center line containing the center line of the counter roll is known from FIG. 6 in DE-331 74 57 A1, in which the device comprises a hydraulic-fluid-actuatable tube and a spring. Various other devices for moving the center of gravity of the supporting forces acting on the press shoe relative to the press shoe are disclosed in U.S. Pat. No. 4,713,147, in which a press shoe support between the press shoe and the frame system of the shoe press is movable in the machine direction relative to the press shoe. In a variant, this press shoe support is a hydraulic-fluid-actuatable loading cylinder for pressing the press shoe against the counter roll. The press shoe support is engaged by a set screw journaled in a stationary frame of the shoe press. Rotation of the set screw causes the shoe support to be translated in the machine direction relative to the press shoe.

SUMMARY OF THE INVENTION

The invention improves upon the mechanism described in the '147 patent by simplifying the mechanism for moving the center line of the loading cylinder relative to the center line of the press. To this end, the invention provides a shoe press in which the loading cylinder is releasably secured on a supporting beam of the shoe press and is positioned on the supporting beam by a pair of eccentric members one of which engages an upstream side of the loading cylinder and the other of which engages a downstream side of the loading cylinder. Each of the eccentric members is eccentric in the machine direction and is fixable on the supporting beam in multiple positions for selectively placing different portions of the eccentric member in engagement with the respective side of the loading cylinder. Thus, the loading cylinder is adjusted in position in the machine direction by releasing the loading cylinder from its attachment to the supporting beam, and changing the positions of the eccentric members so as to place different portions of the eccentric members in engagement with the sides of the loading cylinder.

In a preferred embodiment of the invention, each of the eccentric members has a plurality of engagement surfaces located at different locations in the machine direction relative to the counter roll. The eccentric members are fixable in multiple positions so as to place selected ones of the engagement surfaces in engagement with the loading cylinder. Advantageously, each of the eccentric members is rotatable about an axis for placing a selected one of the engagement surfaces in engagement with the loading cylinder.

In a further preferred embodiment, each of the eccentric members comprises a plate having an eccentric periphery defining the plurality of engagement surfaces. Advantageously, each of the plates has a polygonal periphery and is affixed to the support beam by a fastener and is rotatable about the fastener for changing the position of the plate so as to place a selected one of the sides of the polygonal periphery in engagement with the loading cylinder.

In another preferred embodiment of the invention, there are a plurality of the loading cylinders spaced along the press shoe in a cross-machine direction, and the eccentric members comprise at least two elongate members which are flanged in a varying eccentric manner and arranged on the respective sides of the loading cylinders extending in the cross-machine direction. The elongate members are common to all of the loading cylinders and the flanges of the elongate members engage grooves formed in the respective sides of the loading cylinders.

In accordance with yet another preferred embodiment of the invention, each of the loading cylinders has a piston affixed to the supporting beam, and the shoe press includes an elongate bar which extends along the supporting beam and forms a portion of each of the pistons of the loading cylinders. The elongate bar has grooves which are engaged by the eccentric members.

BRIEF DESCRIPTION OF THE DRAWINGS

The above and other objects, features, and advantages of the invention will become more apparent from the following description of certain preferred embodiments thereof when taken in conjunction with the accompanying drawings, in which.

DETAILED DESCRIPTION OF PREFERRED EMBODIMENTS

Figure 1:
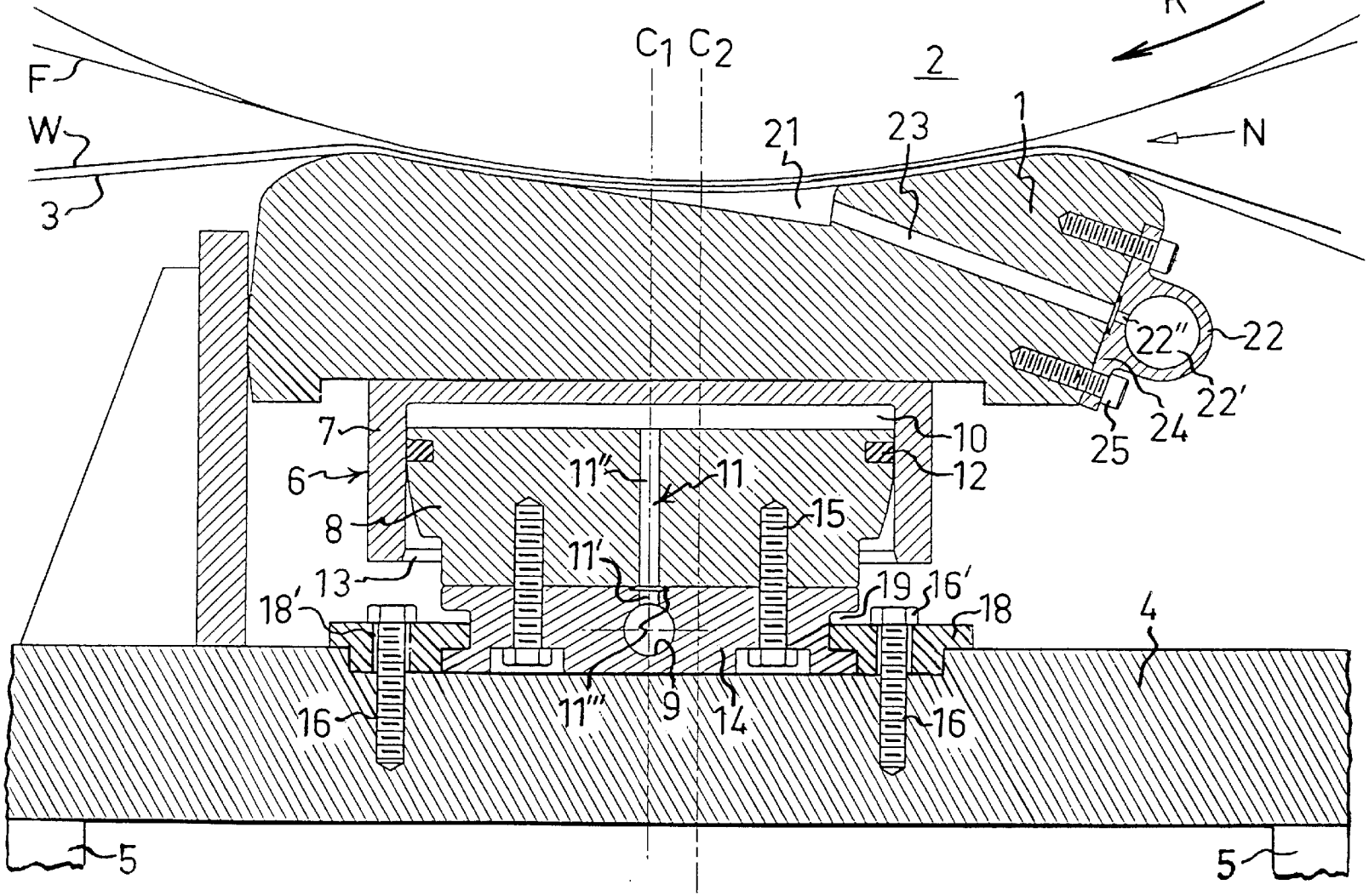
FIG. 1 is a cross-sectional view of a preferred embodiment of the invention, taken on a plane parallel to the machine direction.

The invention is now explained by reference to certain preferred embodiments thereof. It is to be understood, however, that the present invention can be embodied in many different forms and should not be construed as being limited to the embodiments described herein; rather, these embodiments are presented so that this disclosure will be thorough and complete and will fully convey the scope of the invention to those skilled in the art. Like numbers refer to like elements throughout.

In the drawings, it is understood that the press shoe is made in one piece, while there are preferably a plurality of loading cylinders spaced apart along the press shoe in the cross-direction (i.e., transverse to the direction along which the web travels through the extended nip). The loading cylinders may be arranged in a single row or in several rows which are spaced apart in the machine direction (i.e., the direction along which the web travels) of the press shoe.

FIG. 1 illustrates a shoe press for the press section of a paper or board machine, the machine comprising a press shoe 1 and counter roll 2 having the direction of rotation R which between themselves form an extended nip N through which a paper or cardboard web W that is to be dewatered is carried together with a circulated flexible press belt 3 and one or two press felts F (only one shown). A supporting beam 4, which is part of the frame system 5 of the shoe press, has between its side facing the press shoe and the opposite side of the press shoe, a plurality of loading cylinders 6, which are arranged in a row in the longitudinal direction of the shoe press and which have a cylinder 7 and a piston 8, the latter being releasably attached to the beam 4 in a manner that will be described in more detail below. The press shoe 1 is in this case loosely arranged on the cylinder 7, which may have, in a manner known per se, a hydrostatic compartment (e.g., compartment 26 in FIG. 2) in its surface facing the press shoe 1 for floatingly suspending the press shoe. In this piston 8 extends a horizontal duct 9 which is formed in the longitudinal direction of the shoe (i.e., the cross-machine direction) and intended for supplying the working chambers 10 of the loading cylinders with hydraulic fluid, e.g. oil, via a vertical duct 11 in the piston 8, the duct 9 being common to the working chambers of all the loading cylinders, while there is a vertical duct 11 for each working chamber, connecting the common duct 9 with the working chamber. An O-ring 12 seals between the piston 8 and the cylinder 7.

The common duct 9 is preferably formed in a separate horizontal bar 14, and the vertical ducts 11 consist of two duct parts 11' and 11", the duct part 11' being bored through the wall of the bar to the duct 9 in the bar, and the duct part 11" being bored in the piston 8. In this fashion, vertical ducts 11' can be bored in advance in the bar 14 and sealed for use later on, if, for instance, further loading cylinders 6 are to be mounted, or they can be bored only as needed. The bar 14 thus forms part of all pistons 8, screws 15 providing for connection of the piston parts.

Advantageously the bar 14 is made of aluminum or an alloy thereof which can be extruded for obtaining the desired sectional shape of the bar 14 and the desired diameter of the common duct 9. When boring the vertical ducts 11'", a space for an O-seal 11" is arranged at the end of these ducts 11". The duct 9 is supplied with hydraulic fluid from a source (not shown) at one of its ends.

Figure 2:
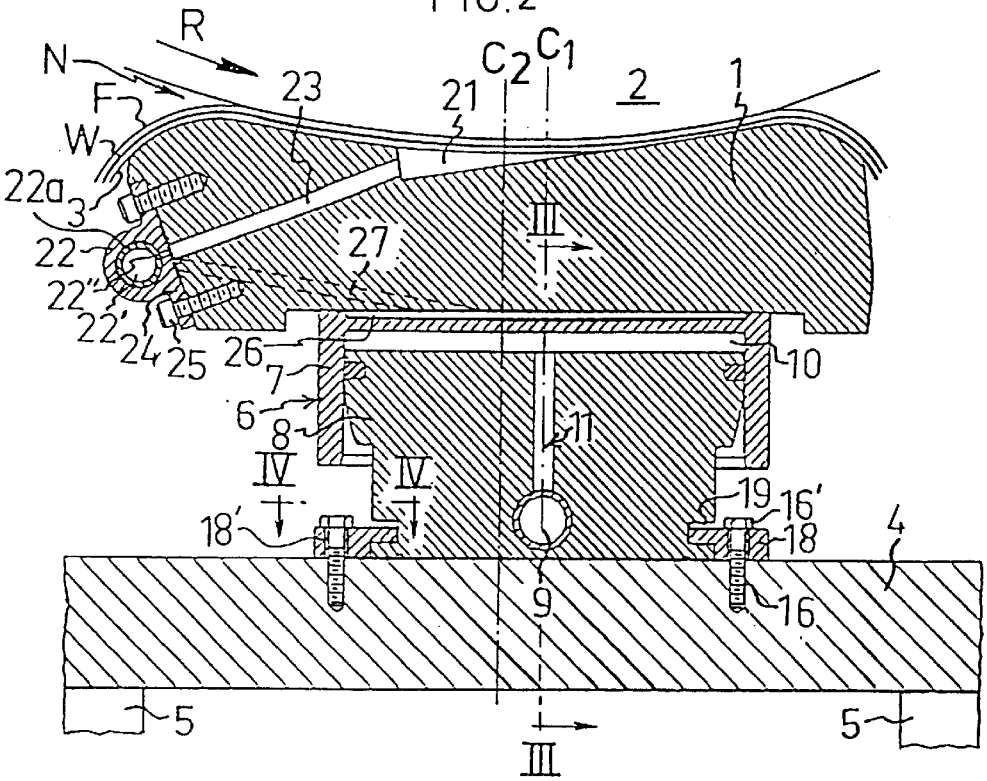
FIG. 2 is a cross-sectional view similar to FIG. 1, showing another preferred embodiment of the invention.
Figure 4:
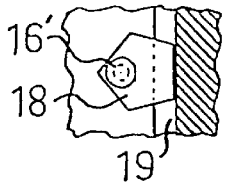
FIG. 4 is a cross-sectional view taken on line IV—IV showing an eccentric plate of the shoe press of FIG. 2.
Figure 3:
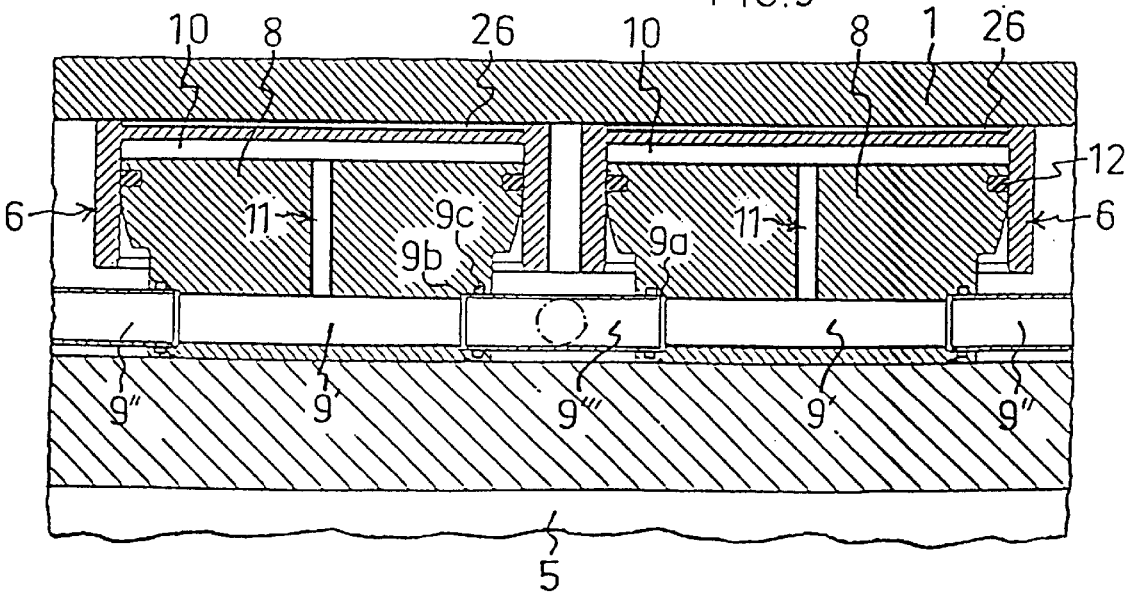
FIG. 3 is a cross-sectional view of the shoe press of FIG. 2 taken along line III—III in FIG. 2.

A further possibility of commonly supplying a plurality of loading cylinders 6 is shown in FIGS. 2 and 3, in which a shoe press having at least two loading cylinders 6 is indicated, two being shown. The common duct 9 is formed of bores 9' in the pistons 8 and of duct components 9" which extend between the loading cylinders 6 and mutually connect the bores 9'. The duct component 9'" is a T piece, the leg of which, as indicated by dash-dotted lines, serves to connect the duct 9 to a hydraulic fluid source (not shown). The ends of the duct components 9" are simply inserted into the bores 9', which have widened ends **9*a* with an abutment 9*b* and an O-ring 9*c* for sealing purposes. This embodiment allows in an advantageous manner connection of the hydraulic fluid source in the duct 9 between two neighboring loading cylinders 6** and also allows in an advantageous manner the absorption of forces caused by heat deformation.

The securing of the pistons 8 on the beam 4 is, according to the invention, effected in such a manner that the loading cylinders 6 can, if desired, be moved relative to the press shoe 1 in the machine direction, thereby moving the center lines C1 of the loading cylinders 6 relative to the center line C2 of the shoe press. This can be desired for the reasons described above.

The securing device consists in the illustrated embodiments of a suitable number of fasteners such as screws 16 and eccentric plates 18 on opposite upstream and downstream sides (in the machine direction) of each piston 8. Each of the upstream and downstream sides of the piston 8 includes a groove 19 formed in the piston 8. The eccentric plates 18 include holes 18' for passage of the screws 16 therethrough, which are screwed in the beam 4, and the plates 18 engage in the grooves 19 in the sides of the pistons 8, such that when tightening the screws by the screw heads 16', the latter clamp the plates 18 against the beam 4, whereby the piston 8 is fixedly secured on the beam 4.

The plates 18 advantageously are identically polygonal and, as shown, eccentric. The center line C1 of the loading cylinders 6 can thus be moved relative to the center line C2 of the shoe press, if desired, by loosening the screws 16 by their heads 16' and rotating the plates about the screws 16 for permitting the desired displacement of the loading cylinder 6 in the machine direction. If the loading cylinder 6 in FIG. 1 is to be moved, for instance, in the running direction of the paper web, the upstream plate 18 (on the right-hand side in FIG. 1) is rotated about its screw 16 in such a manner that a lateral edge thereof which is positioned further away from the screw axis engages in the upstream groove 19, and the downstream plate 18 (on the left in FIG. 1) is rotated about its screw 16 such that the lateral edge thereof which is positioned correspondingly closer to the screw axis engages in the left groove 19.

The eccentric plates 18 can be identical with each other, or they can be of two kinds which are mirror images of each other. FIG. 1 illustrates the plates and the bar 14 partly put into a recess in the beam 4, but the plates and bar need not be set into a recess, as is evident from FIGS. 2 and 3. In the embodiment according to FIG. 1, the plates 18 engage in the grooves 19 in the common bar 14. The circumferential part of the plates, which is not intended to engage in the grooves 19, can be circular if desired.

As an alternative to eccentric plates, and by way of example, a single eccentrically flanged sectional rod, bar, or other elongate member can be arranged on the upstream and downstream sides of the loading cylinders, each of the elongate members having a first flange for engaging the grooves 19 in the pistons 8 and a second flange which is affixed to the beam 4. In this case the desired movement of the loading cylinders can be effected by releasing the elongate members from their attachment to the supporting beam 4 and rotating the members about their longitudinal axes.

FIG. 2 can be considered to represent yet another preferred embodiment of the invention in which the components 18, 18' are not plates but rather are elongate eccentrically flanged members which are shown in cross-section and, thus, are common to all the loading cylinders. The movement of the loading cylinders is effected, after loosening the screws 16, by letting the bars 18 and 18' change places, whereupon the screws 16 are tightened once more. Such an arrangement thus allows movement of the loading cylinders between two positions in the machine direction.

The illustrated embodiments of the invention depict the loading cylinders affixed to the supporting beam. However, it will be appreciated that alternatively the loading cylinders can be affixed to the press shoe 1. The invention is equally applicable to such a shoe press, and the securement of the loading cylinders to the press shoe and the movement of the loading cylinders in the machine direction can be accomplished by the types of devices described herein.

It will also be appreciated that by arranging the common duct 9 for feeding the working chambers 10, there is no need to form a bore in the supporting beam 4 for supplying the working chambers and thus the beam 4 is not weakened. A similar advantage is achieved by the arrangement for supplying one or more hydrostatic compartments 21 arranged in the side of the press shoe 1 facing the counter roll 2 with hydraulic fluid for lubricating the press belt 3. The compartments 21 are supplied with hydraulic fluid through a pipe 22, the hydraulic fluid conducting bore 22' of which (the hydraulic fluid source is not shown) is connected to each compartment by means of a duct 23 formed in the press shoe and a through hole 22" which is formed in the wall of the pipe 22 and which can be designed as a throttle. The pipe 22 is attached to one side of the press shoe, in this case the upstream side, by means of pipe flanges 24 and screws 25. The pipe 22 can be common to all compartments 21 (FIG. 1) or can be separate for each compartment 21 (FIG. 2), in which case the separate pipes 22 communicate with each other via pipe components 22*a* like the duct components 9", thereby making it possible to absorb heat-conditioned deformation forces applied to the pipe 22.

Alternatively, the pipe 22 or pipes 22 and the joint pipes 22*a* can supply hydrostatic compartments 26 between the press shoe and the opposite side of the loading cylinders 6 via ducts 27 (indicated by dashed lines) formed in the press shoe and bores formed in the pipe/pipes, or another pipe or plurality of other pipes with joint pipes can be arranged on the opposite longitudinal side edge of the press shoe for this purpose.

The shoe presses of the present invention have been described as being useful in a press section of a paper or board machine. However, the inventive shoe press is applicable also to calendering operations in a paper or board machine.

Many modifications and other embodiments of the invention will come to mind to one skilled in the art to which this invention pertains having the benefit of the teachings presented in the foregoing descriptions and the associated drawings. For example, while the described embodiments are related to shoe presses in which the force urging the shoe toward the counter roll is provided by one or more hydraulic loading cylinders, it will be appreciated that other types of force actuators may be used for providing such force. The invention encompasses any type of force-providing device where it is desired to shift the center of load relative to the shoe press center line. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A shoe press for pressing a running fibrous web against a counter roll, comprising:

a press shoe having a first side adapted to coact with the counter roll to form an extended nip therebetween through which the web is carried in a machine direction;

a supporting beam spaced from a second side of the press shoe opposite the counter roll;

at least one force actuator disposed between the supporting beam and the press shoe and operable for urging the press shoe toward the counter roll to press the web therebetween, the force actuator having upstream and downstream sides and being releasably secured to one of the supporting beam and the press shoe; and first and second eccentric members engaging the upstream and downstream sides, respectively, of the force actuator, each of the eccentric members being eccentric in the machine direction and being fixable on said one of the supporting beam and press shoe in multiple positions for selectively placing different portions of the eccentric member in engagement with the respective side of the force actuator so as to position the force actuator in various positions in the machine direction.

2. The shoe press of claim 1, wherein each of the eccentric members has a plurality of engagement surfaces located at different locations in the machine direction relative to the counter roll, the eccentric members being fixable in multiple positions so as to place selected ones of the engagement surfaces in engagement with the force actuator.

3. The shoe press of claim 2, wherein each of the eccentric members is rotatable about an axis for placing a selected one of the engagement surfaces in engagement with the force actuator.

4. The shoe press of claim 3, wherein each of the eccentric members comprises a plate having an eccentric periphery defining the plurality of engagement surfaces.

5. The shoe press of claim 4, wherein each of the plates has a polygonal periphery.

6. The shoe press of claim 5, wherein each of the polygonal plates is affixed to the support beam by a fastener and is rotatable about the fastener for changing the position of the plate.

7. The shoe press of claim 1, wherein the force actuator comprises a loading cylinder actuatable by hydraulic pressure.

8. The shoe press of claim 7, further comprising a plurality of loading cylinders spaced along the press shoe in a cross-machine direction, and wherein the eccentric members comprise at least two elongate members which are flanged in a varying eccentric manner and arranged on the respective sides of the loading cylinders extending in the cross-machine direction, the elongate members being common to all said loading cylinders and the flanges of the elongate members engaging grooves formed in the respective sides of the loading cylinders.

9. The shoe press of claim 7, further comprising a plurality of loading cylinders spaced along the press shoe in a cross-machine direction, each of the loading cylinders having a piston affixed to the supporting beam, and further comprising an elongate bar which extends along the supporting beam and forms a portion of each of the pistons of the loading cylinders, the elongate bar having grooves which are engaged by the eccentric members.

10. The shoe press of claim 9, further comprising a duct formed in the elongate bar and extending through the bar in the cross-machine direction, and a plurality of passages formed in the bar and connected to the duct for supplying hydraulic fluid to the working chamber of each of the loading cylinders.

11. The shoe press of claim 10, wherein each of the pistons includes a passage which connects with one of the passages in the elongate bar for supplying fluid to the working chamber.

12. The shoe press of claim 1, wherein the force actuator comprises a loading cylinder which includes a piston affixed to the supporting beam, each of the upstream and downstream sides of the piston having a groove formed in an outer surface thereof, and wherein the eccentric members engage the grooves in the piston.

13. The shoe press of claim 12, wherein the eccentric members are affixed to the supporting beam so as to clamp the piston onto the supporting beam.

14. A shoe press for pressing a running fibrous web against a counter roll, comprising:

a press shoe having a first side adapted to coact with the counter roll to form an extended nip therebetween through which the web is carried in a machine direction;

a supporting beam spaced from a second side of the press shoe opposite the counter roll;

at least one loading cylinder disposed between the supporting beam and the press shoe and operable for urging the press shoe toward the counter roll to press the web therebetween, the loading cylinder having upstream and downstream sides; and a pair of positioning members releasably attached to one of the supporting beam and the press shoe, each of the positioning members engaging one of the sides of the loading cylinder so as to fix the loading cylinder in a first predetermined position on said one of the supporting beam and press shoe, the positioning members having different dimensions in the machine direction such that interchanging the positioning members causes the loading cylinder to be shifted to a second predetermined position spaced from the first position in the machine direction.

15. The shoe press of claim 14, wherein each of the upstream and downstream sides of the loading cylinder includes a flange, and wherein the positioning members engage the flanges and are releasably attached to the supporting beam so as to clamp the loading cylinder onto the supporting beam.

16. The shoe press of claim 14, wherein there are a plurality of the loading cylinders spaced along the press shoe in a cross-machine direction, and wherein the positioning members comprise elongate members which extend in the cross-machine direction and are common to all of the loading cylinders for positioning the loading cylinders in the machine direction.

17. The shoe press of claim 16, wherein each of the positioning members comprises an extruded member.

* * * * *